US006028421A

United States Patent [19]

Kersten et al.

[11] Patent Number: 6,028,421

[45] Date of Patent: Feb. 22, 2000

[54] METHOD FOR LOW-TRANSIENT POWER CONTROL OF ELECTRICAL LOADS AND ELECTRICAL HEATING APPARATUS

[75] Inventors: Reinhard Kersten, Aachen; Albrecht Griesshammer, Keutschach, both of Germany

[73] Assignee: U.S. Philips Corporation, New York, N.Y.

[21] Appl. No.: 09/143,841

[22] Filed: Aug. 31, 1998

[30] Foreign Application Priority Data

Sep. 5, 1997 [DE] Germany ..... 197 38 890

[51] Int. Cl.[7] ..... G05F 1/44

[52] U.S. Cl. ..... 323/322; 323/267; 323/350; 323/351

[58] Field of Search ..... 323/322, 320, 323/324, 350, 351, 267, 268, 271, 272; 361/160; 307/125

[56] References Cited

U.S. PATENT DOCUMENTS 4,871,961 10/1989 Kersten et al. ..... 323/267

5,390,071 2/1995 Kersten et al. ..... 361/160

FOREIGN PATENT DOCUMENTS

0303314B1 2/1989 European Pat. Off. ..... H03K 17/16

*Primary Examiner*—Adolf Deneke Berhane
*Attorney, Agent, or Firm*—Ernestine C. Bartlett; Bernard Franzblau

[57] ABSTRACT

A method for the low-transient power control of electrical loads, particularly temperature-dependent loads electrically divided into essentially equal sub-loads connectable to an a.c. mains in order to receive power. Power control at low power levels utilizes alternately power-off phases, in which none of the sub-loads receive power for at least three a.c. half-waves, and heating phases, in which a temporal concatenation of at least a first and a second basic cycle of three a.c. half-waves supply power to each one of the sub-loads. The first sub-load receives power during one half-wave of the first basic cycle and the second sub-load receives power during one half-wave of the second basic cycle. The power is turned off during the other two half-waves of the first and the second basic cycle. Also disclosed is an electrical heating apparatus which embodies this method.

17 Claims, 2 Drawing Sheets

METHOD FOR LOW-TRANSIENT POWER CONTROL OF ELECTRICAL LOADS AND ELECTRICAL HEATING APPARATUS

BACKGROUND OF THE INVENTION

This invention relates to a method for the low-transient power control of electrical loads, particularly temperature-dependent loads which are each electrically divided into essentially equal sub-loads, the sub-loads of each load being connectable to an a.c. mains in order to receive power.

Such a method is known from EP 303 314 B1. In this known method the sub-loads of each load can be connected to an a.c. power mains selectively in at least three main power stages in series, alternately separately or in parallel. This is effected by means of three triac control devices which are connected in a bridge arrangement which can be controlled by means of a control unit.

In such methods care must be taken that the mains reaction (i.e., switching surges) during power control of the electrical loads does not exceed a maximum permissible value. The maximum permissible values for mains reaction are defined in IEC-1000-3-3: Electro Magnetic Compatibility (EMC), Part 3, Limits-Section 3: Limitation of voltage fluctuations and flicker in low-voltage supply systems for equipment with rated currents <16A.

According to this standard the starting currents are limited in that the maximum permissible relative voltage fluctuations of the supply voltage during one mains half-wave are defined. On the other hand, the maximum permissible mains reaction produced when the loads are turned on and turned off periodically are defined. The mains reaction produced as a result of periodically turning on and turning off the loads is referred to as flickering. For small power levels the standard is difficult to meet in the case of temperature-dependent loads (for example, halogen lamps) when the power rise between turn-off and turn-on increases as result of cooling of the loads.

In the method described in EP 303 314 B1 the two sub-loads are basically arranged in series for the smallest power levels. Three switching elements are employed for controlling the power. If the switching elements are realized by means of semiconductor devices, such as for example, triacs, two of the devices do not have a common operating level and must be driven in an intricate manner via opto-couplers or ignition transformers. Moreover, there is a risk of short-circuit owing to misfiring of the switching elements themselves. If mechanical relays are used as the switching elements for changing over between series/parallel connection, this has the disadvantage that switching noises are produced in a medium-power range. Furthermore, an additional device (relay or triac) is needed.

SUMMARY OF THE INVENTION

It is an object of the invention to provide another method for the power control of electrical loads with minimal switching transients, which method also enables small power levels, particularly below 25% of a given power rating of the load, to be set in compliance with the standard IEC-1000-3-3. It is another object of the invention to provide an electric heating apparatus which operates with minimal switching transients and which enables the EMC standards to be met.

According to the invention the object as regards the method is achieved in that for the power control in a range of low power levels there are provided alternately power-off phases, in which none of the sub-loads is connected to receive power for at least three a.c. half-waves, and heating phases, in which by means of a temporal concatenation of at least a first and a second basic cycle of three a.c. half-waves each one of the sub-loads is connected to receive power, the first sub-load being connected to receive power during one half-wave of the first basic cycle and the second sub-load being connected to receive power during one half-wave of the second basic cycle, and the power being turned off during the other two half-waves of the first and the second basic cycle.

This method does not require a series/parallel change-over. In the power-off phases the power input to both sub-loads is inhibited for at least three a.c. half-waves. The lower power range is, in particular, the power range below 25% of the rated power.

By means of the duty cycle, which is defined as the ratio between the length of time of the heating phase and the length of time of the heating and power-off phase, it is possible to control the power input substantially continuously. In the heating phases the first and the second sub-load are switched to receive power alternately but not simultaneously. For this purpose, the first and the second basic cycle have been provided, which are temporally concatenated. The first and the second basic cycle each comprise three a.c. half-waves, the first sub-load being switched to receive power during one of the three half-waves in the first basic cycle, the power input being turned off during the other two half-waves. The second sub-load is switched to receive power during one of the three half-waves in the second basic cycle, and the power input is turned off during the other two half-waves.

Preferably, always the same ones of the three half-waves of the first and the second basic cycle within the individual heating phases are activated, i.e. either each time the first ones of the three half-waves of the first and of the second basic cycle or each time the second ones of the three half-waves of the first and of the second basic cycle. As a result of this, the first and the second sub-load are always turned on at time intervals of each time three a.c. half-waves. This is favorable for a small mains reaction. As an alternative, always the first one of the three half-waves is switched in the subsequently defined examples.

With such a method it is even possible to realize the lowest power levels (for example, below 12% of a rated power of 1700 W) in compliance with the standard IEC-1000-3-3.

An advantageous variant of the invention is characterized in that the heating phases each comprise a first basic cycle phase, in which the first basic cycle is repeated serially, and a second basic cycle phase, in which the second basic cycle is repeated serially.

In this variant of the method, for example, the first basic cycle phase is initially repeated a plurality of times, i.e. the first sub-load is switched to receive power during every third a.c. half-wave. Subsequently, the second basic cycle phase is periodically repeated a plurality of times, i.e. the second sub-load is switched to receive power during every third a.c. half-wave. This is followed by a power-off phase in which none of the sub-loads is switched to receive power. After this, another heating phase follows, which can start either with the first basic cycle phase or with the second basic cycle phase. Particularly in the case of halogen lamps, this variant has the advantage that the light of the first and the second halogen lamp appears as a continuous light source to the human eye during the first and the second basic cycle phase, respectively. Flickering of the halogen lamp intended for heating during the respective basic cycle phase is not perceptible to the human eye. During the transition between the basic cycle phases the light produced by the first and the second halogen lamp rather travels like a travelling wave from the first to the second halogen lamp and from the second to the first halogen lamp.

Advantageously, this variant is modified in that the first and the second basic cycle phase within a heating phase have different lengths, in the heating phases which succeed one another in time alternately the first basic cycle phase is formed by the shorter cycle phase and the second basic cycle phase by the longer cycle phase, or the second basic cycle phase is formed by the shorter cycle phase and the first basic cycle phase by the longer cycle phase, the shorter cycle phase each time being provided at the beginning of the heating phase.

The power-off phase is always first followed by the shorter cycle phase in which, for example, the first load is switched to receive power for a short time. Subsequently, the other basic cycle, i.e. in the present example the second basic cycle, is turned on during the longer cycle phase, as a result of which the second sub-load is switched to receive power. This longer cycle phase of the second basic cycle is followed by the power-off phase, which power-off phase is followed by the next heating phase, which in the present example is formed by the second basic cycle phase. The shorter cycle phase of the second basic cycle is then followed by the longer cycle phase of the first basic cycle.

Thus, the individual heating phases are divided in such a manner that first the shorter cycle phase and then the longer cycle phase occurs, the shorter and the longer cycle phase being alternately formed by the first and the second basic cycle phase, respectively.

This alternation principle in conjunction with cycle phases of different lengths within a heating phase enables very small mains reactions to be achieved in the case of temperature dependent loads, such as, for example, halogen lamps, also at low power levels, i.e. long switching phases. By means of this alternation principle it is achieved that after the power-off phase always the last sub-load powered before the power-off phase is powered first, namely only for the duration of the shorter cycle phase. The subsequent switching operation to the other colder and, consequently, larger sub-load gives rise to a much smaller mains reaction than the first switching operation after a longer power-off phase because then only the change in overall load takes effect.

In this variant it has proved to be particularly advantageous that the shorter cycle phase each time comprises six a.c. half-waves. Thus, after the power-off phase the first or the second basic cycle is repeated only two times and is then followed by the longer cycle phase of the respective other basic cycle. For example, if the first basic cycle is repeated two times after the power-off phase, this is followed by a multiple repetition of the second basic cycle. This is followed by the power-off phase and in the subsequent heating phase the second basic cycle is repeated two times as the shorter cycle phase, after which the first basic cycle is repeated a plurality of times as the longer cycle phase. Such a method enables even the smallest power levels (for example, 5% of a rated power of 1700 W) to be realized in compliance with the standard IEC-1000-3-3.

Another advantageous variant of the invention is characterized in that the first and the second basic cycle are repeated alternately in the heating phases.

Thus, during the power-off phases the first basic cycle is effected once, followed by one time the second basic cycle, then once more the first basic cycle, followed by one more time the second basic cycle etc. As a result of the continual switching between the first and the second sub-load such heating phases are somewhat unpleasant to the eye when halogen lamps are used as heating loads. The human eye perceives these patterns as "flickering". However, these patterns have the advantage that they exhibit small mains reactions in a power level range of, for example, 12% to 25% of a rated power of 1700 W.

In all of the methods described in the foregoing it is advantageous that the last sub-load which has been connected to receive power before a power-off phase is always the first sub-load connected to receive power after the power-off phase.

If the heating loads are temperature-dependent resistive loads, such as for example halogen lamps, these methods ensure that the hottest and, consequently, the highest resistance always is energized first after a power-off phase. As a result of this, the mains reaction at the transition between the power-off phase and the heating phase is smaller than in the case that after the power-off phase the colder sub-load and, consequently, the larger sub-load having the smaller resistance would have been energized first. The subsequent switching operation within the heating phase from the one to the other sub-load gives rise to a much smaller mains reaction than the first switching operation after the power-off phase.

Particularly in a power level range between approximately 12% to 25% of a rated power of approximately 1700 W this alternation principle has distinct advantages as regards the mains reaction.

In the variant of another method power control in the heating phase is effected in that, in addition to the first and the second basic cycle, a third basic cycle is used, in which third basic cycle the first sub-load is switched to receive power during one of the three half-waves, the second sub-load is switched to receive power during a further halfwave, and none of the two sub-loads is switched to receive power during the other halfwave.

This third basic cycle can be employed in different ways.

For low and medium power levels (for example, 12% to 44% of a rated power of 1700 W) the variant just described can be combined as follows. After the first and the second basic cycle the third basic cycle with at least three half-waves occurs. After this, the power-off phase with at least three half-waves follows either directly or after interposition of a first and a second basic cycle. This method has more mains reaction at low power levels than that in the earlier variants described above. However, it has the advantage that both lamps appear to light up simultaneously to the human eye, which gives a steadier optical impression. It is also advantageous if (for example, for safety reasons) a more intensive overall light impression is required.

By a suitable combination of all of the three basic cycles with a power-off phase the whole power level range from low to medium power levels can be realized almost continuously (for example, 10% to 44% of the rated power of 1700 W). It leads to a long phase of the third basic cycle and a long power-off phase with short transitions, for example, consisting of the direct succession of a first and a second basic cycle.

For medium power levels (for example 25% to 44% of a rated power of 1700 W) the power-off phase of at least three half-waves can be omitted completely because this power range is obtained merely by combining all of the three basic cycles. A first basic cycle covering at least three half-waves is then followed by a second basic cycle of at least three half-waves and a third basic cycle of at least three half-waves, in which the first sub-load is switched to receive power during at least one of the three half-waves, the second sub-load is switched to receive power during a further half-wave and none of the sub-loads is switched to receive power during the other half-wave. The advantage of a smaller mains reaction is offset by the disadvantage of the overall optical impression. In the first two sub-phases the light travels from one halogen lamp to the other, which is avoided in the first variant.

When only the first and the second basic cycle without power-off phases are used, a power level of approximately 25% of the rated power is attained. When only the third basic cycle is used, a power level of approximately 44% of the rated power is attained. By a suitable combination of the first, the second and the third basic cycle the power level range can be controlled substantially continuously between 25% of the rated power and 44% of the rated power.

According to the invention the object as regards the heating apparatus is achieved in that a power switch is arranged in series with each of the two sub-loads, the two sub-loads in series with their respective power switches are arranged in parallel, there is provided a control unit for controlling the power switches, and the control unit controls the power switches in such a manner that for a range of low power levels alternately power-off phases, in which none of the sub-loads is connected to receive power for at least three a.c. half-waves, and heating phases, in which by means of a temporal concatenation of at least a first and a second basic cycle of three a.c. half-waves each one of the sub-loads is connected to receive power, are obtained, the first sub-load being connected to receive power during one half-wave of the first basic cycle and the second sub-load being connected to receive power during one half-wave of the second basic cycle, and the power being turned off during the other two half-waves of the first and the second basic cycle.

As power switches it is possible to use, for example, triacs. To drive the two sub-loads this parallel arrangement requires only two power switches, which can be controlled by the control unit. As a result of this, the present arrangement is very simple.

BRIEF DESCRIPTION OF THE DRAWINGS

Some variants of the invention will be described hereinafter, by way of examples, with reference to FIGS. 1 to 6 of the drawings. In the drawings.

DESCRIPTION OF THE PREFERRED EMBODIMENTS

Figure 1:
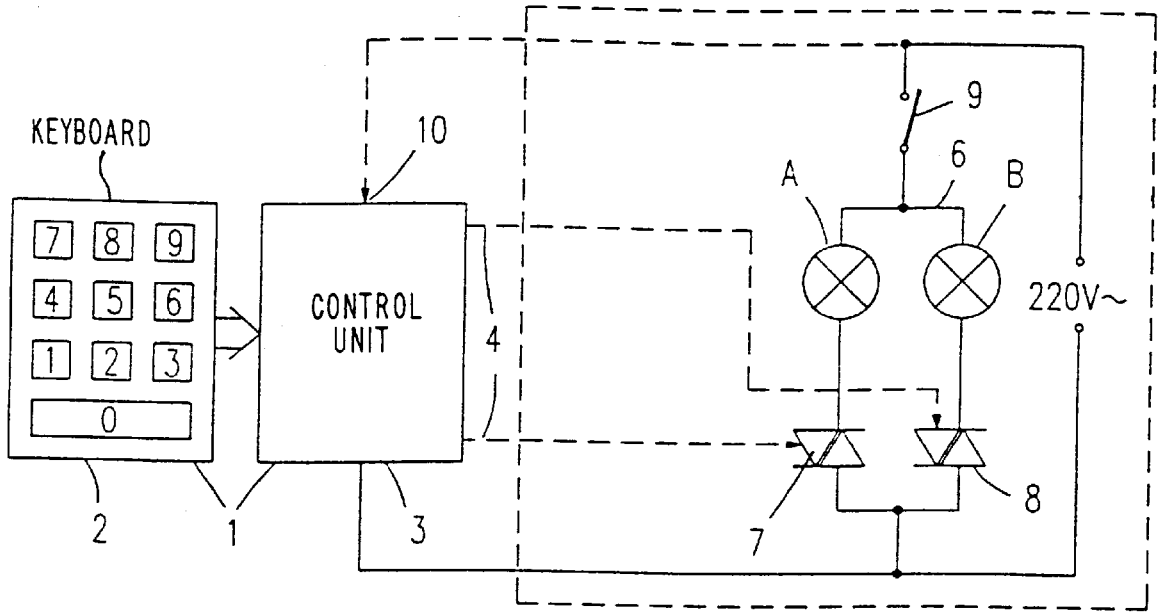
FIG. 1 shows an arrangement suitable for carrying out the method, which arrangement comprises one load having two sub-loads, the two sub-loads being arranged in parallel and being energizable with an alternating voltage by means of one power switch each.

An arrangement shown in FIG. 1, for carrying out the method for low-transient power control of electrical loads, comprises a control unit 1 including an input keyboard 2 and an electronic control unit 3. The electronic control unit 3 can be realized by means of a microprocessor circuit. The control unit 3 serves for the low-transient power control of an electrical heating load 6 which comprises a first sub-load A and a second sub-load B. In the present example, the sub-loads A and B are halogen lamps arranged in a light cooking appliance. The first sub-load A is arranged in series with a power switch formed by a first triac 7. The second sub-load B is arranged in series with a power switch formed by a second triac 8. The series arrangement of the first sub-load A and the first triac 7 is arranged in parallel with the series arrangement of the second sub-load B and the second triac 8. This parallel arrangement is arranged to receive the mains voltage via a safety switch 9. The mains voltage is applied to an input 10 of the control unit 3, so as to allow the control unit 3 to detect the zero crossings of the a.c. half-waves of the mains voltage. The electronic control unit 3 is coupled to the first triac 7 and the second triac 8 by means of two control lines 4. By means of these control lines 4 control signals can be applied from the control unit 3 to the first triac 7 and the second triac 8. By suitably controlling the first triac 7 and the second triac 8, respectively, the first sub-load A and the second sub-load B can be connected to the mains voltage by means of the control unit 3 and the control lines 4.

Figure 2:
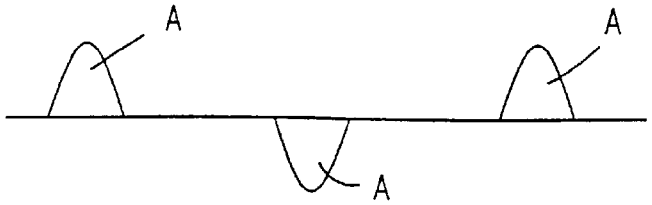
FIG. 2 shows a first basic cycle in which the first sub-load is energized with an alternating voltage in every third a.c. half-wave.

FIG. 2 shows diagrammatically a first basic cycle in which the first triac 7 is turned on during every third a.c. half-wave, as a result of which the mains voltage of 220 V is applied to the first sub-load A during every third a.c. half-wave.

Figure 3:
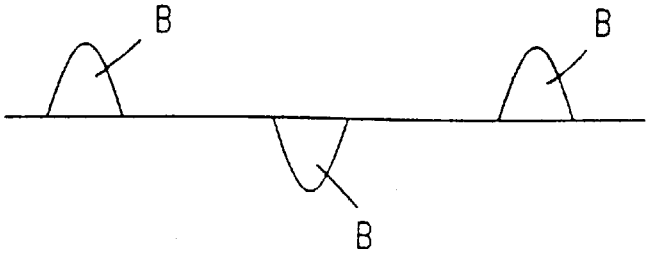
FIG. 3 shows a second basic cycle in which the second sub-load is energized with an alternating voltage in every third a.c. half-wave.

FIG. 3 shows diagrammatically a second basic cycle in which the second triac 8 is turned on during every third a.c. half-wave, as a result of which the mains voltage of 220 V is applied to the second sub-load B during every third a.c. half-wave.

For the power control of the sub-loads A and B heating phases have been provided, in which the first and the second basic cycle are combined in an appropriate manner, and switching phases, in which neither the sub-load A nor the sub-load B is powered.

Thus, the basic cycles are patterns which are activated during very third half-wave. Basic cycles which are activated at a rate less frequent than every third half-wave give rise to substantial flickering and are also visually unpleasant. Basic cycles which are activated more frequently than during every third half-wave, in conjunction with power-off phases, cause excessive power transients in the lowest range of power levels and are therefore not particularly suitable either.

Figure 4:
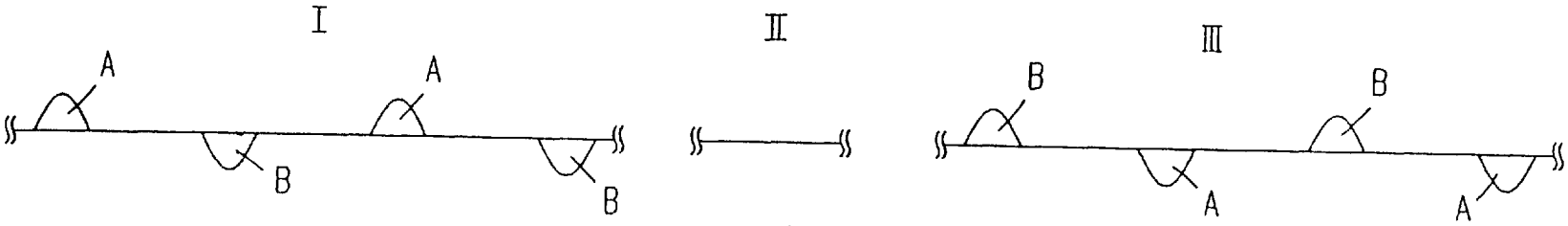
FIG. 4 shows a switching cycle in which the first and the second basic cycle are alternately repeated in a heating phase.

FIG. 4 shows diagrammatically a first example of a switching pattern which comprises a combination of the first and the second basic cycle. In the switching pattern shown in FIG. 4 the first basic cycle and the second basic cycle alternate with one another in a first heating phase I, as a result of which the first sub-load A and the second sub-load B are powered alternately during every third a.c. half-wave. The heating phase I is followed by a power-off phase II, in which neither of the sub-loads A and B are powered and whose length of time can be varied in accordance with the desired power. The power-off phase II is followed by a heating phase III, in which the second basic cycle B and the first basic cycle A again alternate with one another, as a result of which the first sub-load B and the second sub-load A are powered alternately during every third a.c. half-wave. In the heating phase I the sub-load B is the last sub-load powered immediately before the power-off phase II. In the heating phase m following the power-off phase II this sub-load B, which is the last sub-load powered in the heating phase I, is the first one to be powered. Hereinafter, this principle is referred to as the alternation principle. This alternation principle ensures that after a power-off phase always the last sub-load powered before the power-off phase is powered first. In the case of sub-loads formed by halogen lamps this has the advantage that after a power-off phase always the hottest halogen lamp having the higher resistance is powered first. This alternation principle enables the flicker standard IEC-1000-3-3 to be complied with even at very low power levels down to 5% of the rated power.

Figure 5:
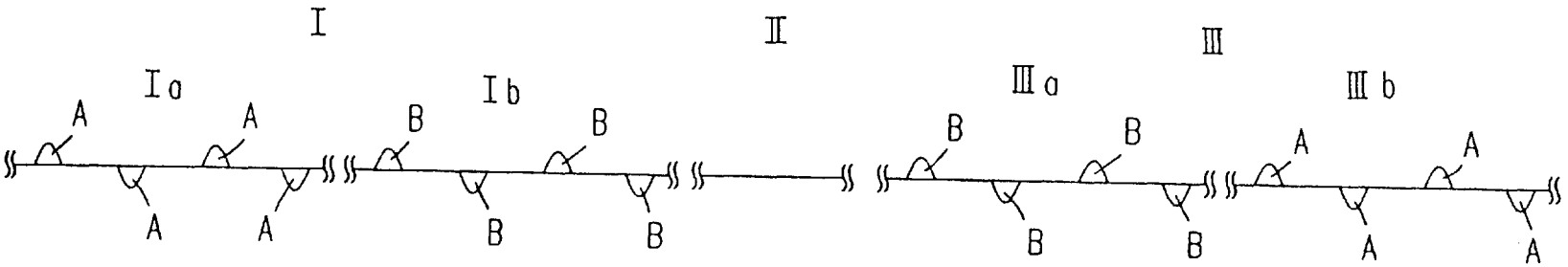
FIG. 5 shows a switching cycle in which the heating phases comprise first basic cycle phases, in which the first basic cycle is repeated serially, and second basic cycle phases, in which the second basic cycle is repeated serially.

FIG. 5 shows a second example of a switching pattern in which the heating phase I comprises a heating phase Ia and a heating phase Ib. In the heating phase Ia the first basic cycle phase is repeated serially, i.e. the first sub-load A is powered during every third a.c. half-wave. The heating phase Ia is linked up with the heating phase Ib, in which the second basic cycle phase is repeated serially, as a result of which the second sub-load B is powered during every third a.c. half-wave. The number of repetitions of the first basic cycle in the heating phase Ia and of the second basic cycle in the heating phase Ib can be selected to differ in dependence upon the desired power level. In order to guarantee a uniform power output of the first sub-load A and of the second sub-load B the heating phases Ia and Ib have been given the same length in the present example. The heating phase I is followed by a power-off phase II, for which a length is chosen which differs in dependence upon the desired power level. This power-off phase II is followed by a heating phase III, which again comprises a heating phase IIIa and a heating phase IIIb. The power-off phase II is first of all followed by the heating phase IIIa, in which the second basic cycle is repeated serially, as a result of which the second sub-load B is powered during every third half-wave. The heating phase IIIa is followed by the heating phase IIIb, in which the first basic cycle is repeated serially, as a result of which the sub-load A is powered during every third a.c. half-wave. It is to be noted that the power-off phase II is first of all followed by the serial repetition of the second basic cycle B because the first heating phase I has ended with the serial repetition of the second basic cycle. Thus, after the power-off phase II the hottest halogen lamp of the sub-load B, which is the last lamp heated before the power-off phase II and which consequently has a higher resistance than the halogen lamp of the sub-load A, is powered first, which, as already stated, results in a favorable flicker behavior and a small mains reaction, i.e. small transient or surge effects.

Figure 6:
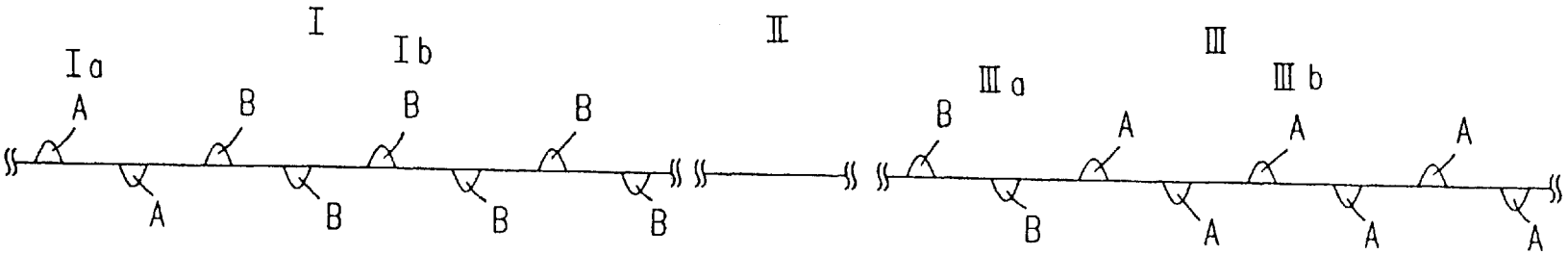
FIG. 6 shows a switching cycle in which the first and the second basic cycle phase within a heating phase have different lengths.

FIG. 6 shows a third example of a switching pattern in which the heating phases I and III respectively comprise heating phases Ia, Ib and IIIa, IIIb of different lengths. In the heating phase Ia the first basic cycle is effected twice as the first basic cycle phase, as a result of which this heating phase Ia has a length of six a.c. half-waves and the first sub-load A is powered twice. The heating phase Ia is followed by a heating phase Ib, in which the second basic cycle is repeated serially several times, as a result of which the second sub-load B is powered during every third a.c. half-wave. The number of repetitions of the second basic cycle within the heating phase Ib can be varied depending on the desired power level. The heating phase I is subsequently followed by a power-off phase II, whose length of time can also be varied depending on the desired power level. The power-off phase II is followed by the heating phase III, which begins with a heating phase IIIa, in which the second basic cycle is effected twice, as a result of which this heating phase IIIa has a length of six a.c. half-waves and the sub-load B is powered twice. It is to be noted that after the power-off phase II, powering starts with the sub-load B because this sub-load B is the last sub-load heated before the power-off phase II and the halogen lamp of the sub-load B is consequently hotter than the halogen lamp of the sub-load A and, consequently, has a higher resistance. Thus, by powering the larger sub-load B a smaller transient effect, i.e. mains reaction, is produced than in the case where power would be applied to the smaller sub-load A. The heating phase IIIa is followed by the heating phase IIIb, in which the first basic cycle is repeated serially, as a result of which the third sub-load A is powered during every third a.c. half-wave. The number of periodic repetitions of the first basic cycle within the heating phase IIIb can be varied depending on the desired power level. However, the heating phases Ib and IIIb should have the same length so as to ensure that the same average power is delivered by the sub-load A and the sub-load B.

The switching pattern as shown in FIG. 6 is particularly suitable for a power-level range between 5% and 12% of the rated power. In this power-level range the switching pattern as shown in FIG. 6 enables very small flicker values and very small transient effects to be realized in compliance with the standard IEC-1000-3-3. This is particularly important in heating apparatuses because keep-warm processes are effected in this power-level range.

In a power-level range between 12% and 25% of the rated power the switching patterns as shown in FIGS. 4 and 5 are more advantageous as regards the mains reaction than the switching pattern as shown in FIG. 6. In this power-level range the afore-mentioned alternation principle is particularly advantageous.

By means of the described methods a noiseless power control is possible in the whole power-level range because no mechanical switching elements are required.

We claim:

1. A method for the low-transient power control of electrical loads, which loads are each electrically divided into essentially equal sub-loads, the method comprising: connecting the sub-loads of each load to an a.c. mains in order to receive power, wherein for power control in a range of low power levels, providing alternately;

power-off phases, by disconnecting the sub-loads from the a.c. mains so that none of the sub-loads is connected to receive power for at least three a.c. half-waves, and heating phases, in which by means of a temporal concatenation of at least a first and a second basic cycle of three a.c. half-waves each one of the sub-loads is connected to receive power, by connecting the first sub-load to receive power during one half-wave of the first basic cycle and connecting the second sub-load to receive power during one half-wave of the second basic cycle, and turning off the power during the other two half-waves of the first and the second basic cycle.

2. A method as claimed in claim 1, wherein the heating phases each comprise a first basic cycle phase, repeated serially, and a second basic cycle phase, repeated serially.

3. A method as claimed in claim 2, wherein the first and the second basic cycle phase within a heating phase have different lengths, in the heating phases which succeed one another in time alternately the first basic cycle phase is formed by the shorter cycle phase and the second basic cycle phase by the longer cycle phase, or the second basic cycle phase is formed by the shorter cycle phase and the first basic cycle phase by the longer cycle phase, the shorter cycle phase each time being provided at the beginning of the heating phase.

4. A method as claimed in claim 3, wherein the shorter cycle phase each time comprises 6 a.c. half-waves.

5. A method as claimed in claim 1, which comprises; repeating the first and the second basic cycle alternately in the heating phases.

6. A method as claimed in claim 1, wherein the last sub-load which has been connected to receive power before a power-off phase is always the first sub-load connected to receive power after the power-off phase.

7. A method as claimed in claim 1, which comprises; providing a temporal concatenation of the first, the second and a third basic cycle in the heating phases, by connecting the first sub-load to receive power during a half-wave of the third basic cycle, connecting the second sub-load to receive power during a further half-wave of the third basic cycle, and turning off the power during the other half-wave of the third basic cycle.

8. The method as claimed in claim 1 wherein said electrical loads are temperature-dependent loads.

9. An electrical apparatus for controlling power to at least one electrical load which comprises first and second sub-loads, comprising: first and second power switches connected in series with the first and second sub-loads, respectively, means coupling the first and second sub-loads, in series with their respective power switches, in parallel, and a control unit for controlling the power switches in a manner such that for a range of low power levels, alternately there is produced power-off phases, in which none of the sub-loads is connected to receive power for at least three a.c. half-waves, and heating phases, in which by means of a temporal concatenation of at least a first and a second basic cycle of three a.c. half-waves each one of the sub-loads is connected to receive power, wherein the power switches are operated so that the first sub-load is connected to receive power during one half-wave of the first basic cycle and the second sub-load is connected to receive power during one half-wave of the second basic cycle, and the power to the sub-loads is turned off during the other two half-waves of the first and the second basic cycle.

10. The electrical power control apparatus as claimed in claim 9 for controlling power to first and second sub-loads comprising first and second halogen lamps, respectively, further comprising:

a pair of input terminals for connection to a source of AC supply voltage, means connecting a first series circuit of the first sub-load and the first power switch to said pair of input terminals, means connecting a second series circuit of the second sub-load and the second power switch to said pair of input terminals, and the control unit controls the switching of the first and second power switches so that the power switch last connected to input terminals to supply power to its sub-load before a power-off phase begins is the power switch first connected to the input terminals to supply power to its sub-load at the end of said power-off phase.

11. The electrical power control apparatus as claimed in claim 9 further comprising:

a pair of input terminals for connection to a source of AC supply voltage, means coupling the parallel combination of the first and second sub-loads and their respective series connected first and second power switches to said pair of input terminals, and the control unit controls the switching of the first and second power switches so that the heating phases comprise first and second heating phases each of which comprise a serially repeated first basic cycle phase and a serially repeated second basic cycle phase.

12. The electrical power control apparatus as claimed in claim 9 further comprising:

first and second input terminals for coupling a source of AC supply voltage to said power switches and sub-loads, and the control unit controls the switching of the first and second power switches so that the heating phases comprise first and second heating phases each of which comprise a serially repeated first basic cycle phase and a serially repeated second basic cycle phase, wherein the first and second basic cycle phases within a heating phase have different lengths with the first basic cycle phase being shorter than the second basic cycle phase, the shorter cycle phase occurring at the start of the heating phase.

13. The electrical power control apparatus as claimed in claim 9 further comprising:

first and second input terminals for coupling a source of AC supply voltage to said power switches and sub-loads, and the control unit controls the switching of the first and second power switches so that the first and second basic cycles of a heating phase are repeated alternately.

14. The electrical power control apparatus as claimed in claim 9 further comprising:

first and second input terminals for coupling a source of AC supply voltage to said power switches and sub-loads, and the control unit controls the switching of the first and second power switches so that each heating phase also includes a third basic cycle, and the control unit controls the power switches such that the first sub-load receives power during a first half wave of the third basic cycle, the second sub-load receives power during a second half wave of the third basic cycle, and neither sub-load receives power during a third half wave of the third basic cycle.

15. The electrical power control apparatus as claimed in claim 9 further comprising:

first and second input terminals for coupling a source of AC supply voltage to said power switches and sub-loads, and a first junction point between the first sub-load and the first power switch is unconnected to a second junction point between the second sub-load and the second power switch.

16. The electrical power control apparatus as claimed in claim 9 further comprising:

a pair of input terminals for connection to a source of AC supply voltage, and means for coupling at least one input terminal of the control unit to one of said pair of input terminals.

17. The electrical power control apparatus as claimed in claim 9 wherein said first and second sub-loads comprise first and second halogen lamps, respectively.

* * * * *